United States Patent [19]

Murai

[11] Patent Number: 4,893,851

[45] Date of Patent: Jan. 16, 1990

[54] THUMB TURN LATCH

[75] Inventor: Ryukichi Murai, Toyama, Japan

[73] Assignee: Yoshida Kogyo K. K., Tokyo, Japan

[21] Appl. No.: 251,357

[22] Filed: Sep. 30, 1988

[30] Foreign Application Priority Data

Oct. 1, 1987 [JP] Japan ..... 62-159020[U]

[51] Int. Cl.[4] ..... E05C 5/02

[52] U.S. Cl. ..... 292/204; 292/59

[58] Field of Search ..... 292/204, 59, DIG. 50, 292/218, 209, 202, 213, 194, 60, 57, 62; 411/553, 552, 549, 349

[56] References Cited

U.S. PATENT DOCUMENTS

| | | | |
|---|---|---|---|
| 3,724,888 | 4/1973 | James | 292/DIG. 38 |
| 3,849,839 | 11/1974 | Zimber | 411/349 |
| 4,391,461 | 7/1983 | Diebele | 292/204 |

FOREIGN PATENT DOCUMENTS 201901 12/1984 Italy .

*Primary Examiner*—Richard E. Moore

*Attorney, Agent, or Firm*—Hill, Van Santen, Steadman & Simpson

[57] ABSTRACT

A thumb turn latch includes a latch body having a split shank snap-fitted in a stepped hole in a retainer. The stepped hole has a cam surface engageable with an enlarged foot on the split shank to urge the latch body toward the retainer.

7 Claims, 4 Drawing Sheets

THUMB TURN LATCH

BACKGROUND OF THE INVENTION

1. Field of the Invention

The present invention relates to a thumb turn latch designed to be turned by the thumb and finger though an angle of 90 degrees for releasably holding the flap of a bag-like article in a closing position.

2. Description of the Prior Art

A typical example of thumb turn latch of the type described is disclosed in Italian Utility Model Registration No. 201901. The disclosed latch includes a latch body having a grip head and a cylindrical stem extending centrally from a lower surface of the grip head. The grip head has a locking ridge disposed on and extending diametrically across the lower surface. The cylindrical shank terminates in an enlarged foot having an upwardly tapering cam surface. The latch body is rotatably mounted on a retainer attached to the body of a bag-like article. The retainer includes a split sleeve rotatably receiving therein the shank of the latch body, and a crisscross groove formed in an upper surface of the retainer for receiving the locking ridge of the latch body to lock the latch body selectively in a locking and a releasing position which are angularly spaced by 90 degrees. When the latch body is held in the locking position or the releasing position in which the locking ridge is received in the crisscross groove, the lower end of the split sleeve is held in abutment with the upwardly tapering cam surface of the shank of the latch body. In this instance, due to the camming action of the upwardly tapering cam surface, the latch body is urged downwardly toward the retainer. When the grip head is turned to move the latch body from the locking position to the releasing position and vice versa, the locking ridge is released from the crisscross groove and slides up onto the upper surface of the retainer, causing the latch body to be moved upwardly. With this upward movement of the latch body, the upwardly tapering cam surface of the enlarged foot is forced into the split sleeve of the retainer, whereupon the split sleeve, which is composed of two opposing resilient thin walls, is spreaded by the cam surface. This forcible deformation of the two opposing walls of the split sleeve continues until the locking ridge is received again in the crisscross groove to lock the latch body in the releasing position.

The known thumb turn latch of the foregoing construction is however disadvantageous in that the split sleeve of the retainer is likely to be damaged or broken due to fatigue caused by repeated bending of the two opposing resilient thin walls of the split sleeve during use of the bag-like article.

SUMMARY OF THE INVENTION

With the foregoing drawbacks of the prior art device in view, it is accordingly an object of the present invention to provide a thumb turn latch which is durable in construction and has a long service like.

According to the present invention, there is provided a thumb turn latch comprising a latch body and a retainer movably holding thereon the latch body. The latch body has a grip head and a split shank extending perpendicularly from a lower surface of the grip head and terminating in an enlarged foot. The grip head has on the lower surface at least one locking ridge extending radially relative to a central axis of the split shank. The retainer includes a bearing portion slidably receiving therein the split shank of the shank body. The bearing portion has a stepped hole including a small-diameter portion extending downwardly form an upper surface of the bearing portion, and a large-diameter portion contiguous to the small-diameter portion and receiving therein the enlarged foot of the split shank. The large-diameter portion has an upwardly tapering cam surface disposed adjacent to the small-diameter portion and engageable with the enlarged foot to urge the latch body downwardly toward the retainer. The bearing portion further has in its upper surface a crisscross guide groove extending radially outwardly from the stepped hole for receiving therein the locking ridge to lock the latch body in position against rotation relative to the retainer.

Many other advantages and features of the present invention will become manifest to those versed in the ar upon making reference to the detailed description and the accompanying sheets of drawings in which a preferred structural embodiment incorporating the principles of the present invention is shown by way of example.

DETAILED DESCRIPTION

Figure 1:
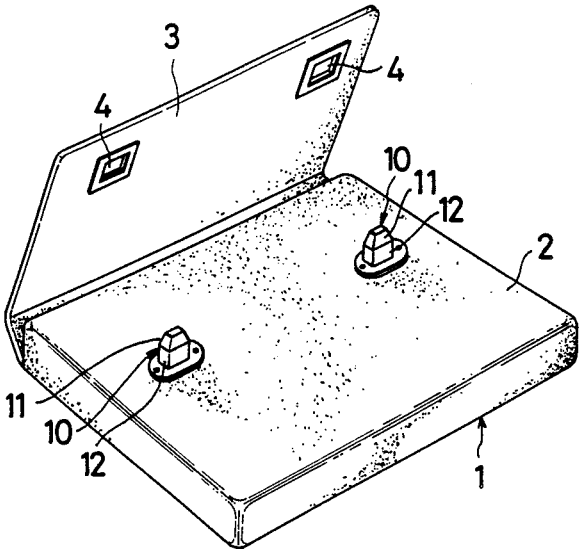
FIG. 1 is a schematic perspective view of a briefcase incorporating a thumb latch according to the present invention.
Figure 2:
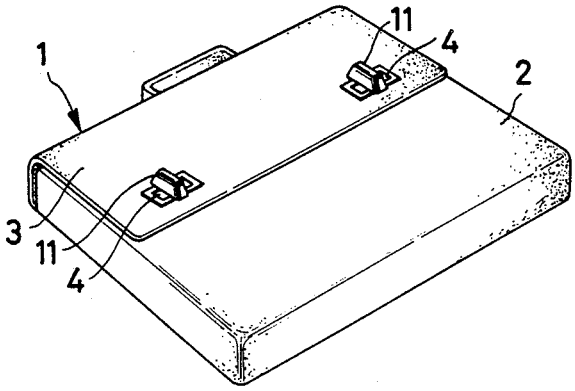
FIG. 2 is a view similar to FIG. 1, showing the briefcase as it is closed by the thumb turn latch.

FIGS. 1 and 2 show a briefcase 1 having a closure composed of a pair of laterally spaced thumb turn latches 10, 10 embodying the present invention.

The thumb turn latches 10 are mounted on a body 2 of the briefcase 1 and releasably engageable with a pair of eyelets 4, 4, respectively, attached to a flap 3 of the briefcase 1 to close the briefcase 1. Each of the thumb turn latches 10 includes a latch body 11 rotatably mounted on a retainer 12 secured to the body 2 and adapted to be turned by the thumb and finger to move between a releasing position shown in FIG. 1 in which the latch body 11 is freely receivable in the corresponding eyelet 4, and a locking position shown in FIG. 2 in which the latch body 11 is held in locking engagement with the eyelet 4. The locking and releasing positions are angularly spaced apart by an angle of 90 degrees.

Figure 3:
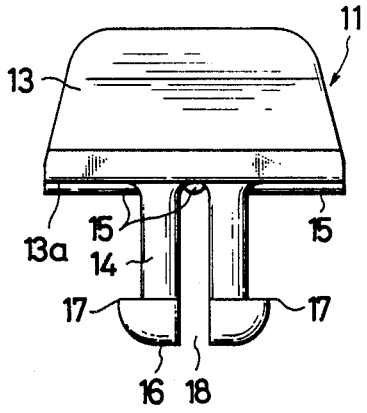
FIG. 3 is an enlarged front elevational view of a latch body of the thumb turn latch.
Figure 4:
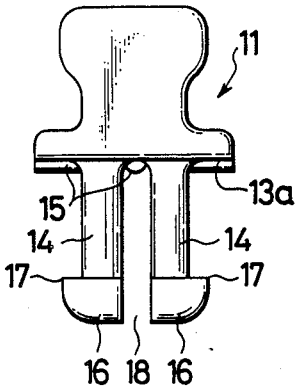
FIG. 4 is a side view of FIG. 3.
Figure 5:
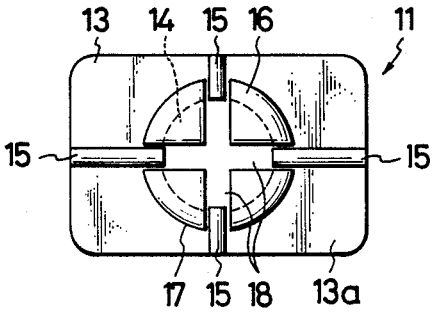
FIG. 5 is a bottom view of FIG. 3.

The thumb burn latch body 11 is molded of synthetic resin and includes, as shown in FIGS. 3–5, a grip head 13 adapted to be gripped by user's fingers for turning the latch body 11, and a split cylindrical shank 14 disposed centrally on and extending perpendicularly from a lower surface 13*a* of the grip head 13.

The grip head 13 has on its lower surface 13*a* four locking ridges 15 angularly equidistant from one another and extending radially inwardly from the outer peripheral edge of the grip head 13 toward the central axis of the split cylindrical shank 14. The locking ridges 16 have rounded upper edges for camming action described later. The number of the locking ridges 15 is not limited to four as in the illustrated embodiment but only one locking ridge may be employed. The split cylindrical shank 14 terminates in an enlarged foot 16 of an interrupted circular shape. The enlarged foot 16 has a sharp outer edge 17 at an upper side thereof. The split cylindrical shank 14 has two longitudinal slits 18 extending perpendicular to one another in crisscross fashion to divide the shank 14 into four identical segments. With the slits 18 thus provided, the split shank 14 is resiliently contractible radially inwardly.

Figure 6:
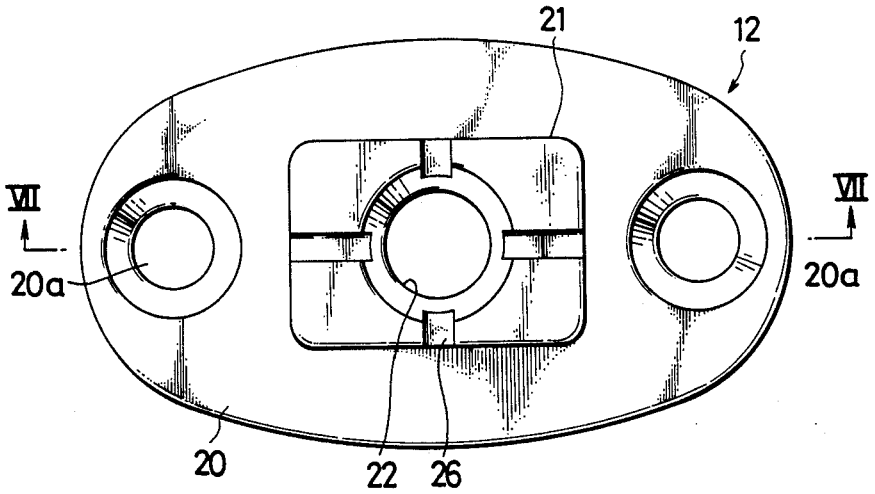
FIG. 6 an enlarged plan view of a retainer of the thumb turn latch.
Figure 7:
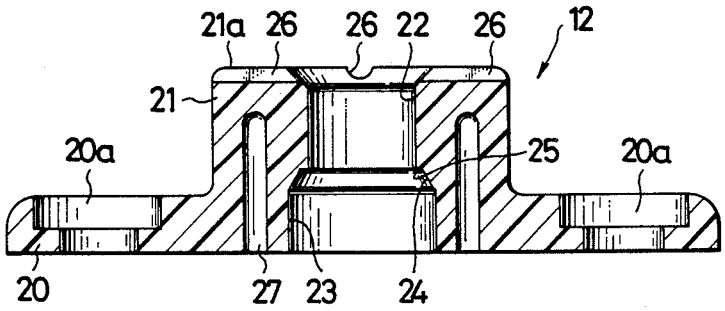
FIG. 7 a cross-sectional view taken along line VII—VII of FIG. 6.

The retainer 12 is molded of synthetic resin and includes, as shown in FIGS. 6 and 7, a flat base 20 and a bearing portion 21 disposed centrally on and projecting perpendicularly from an upper surface of the base 20 for movably receiving therein the shank 14 of the latch body 11.

Figure 8:
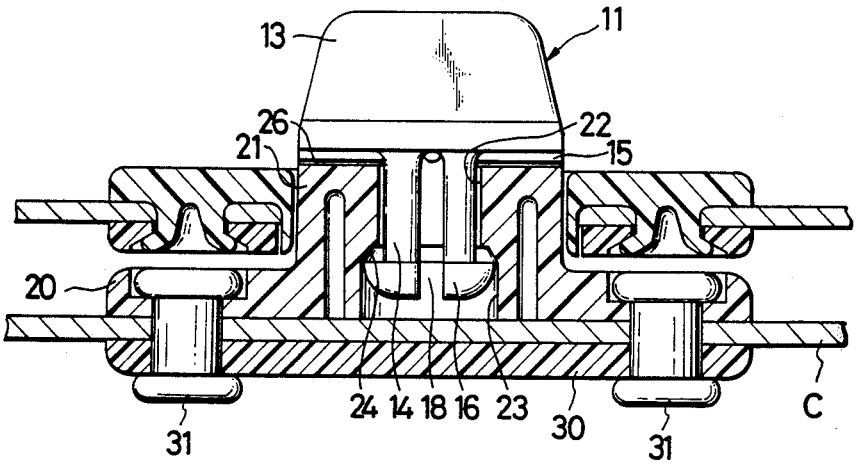
FIGS. 8 and 9 are enlarged cross-sectional views illustrative of the operation of the thumb turn latch.
Figure 9:
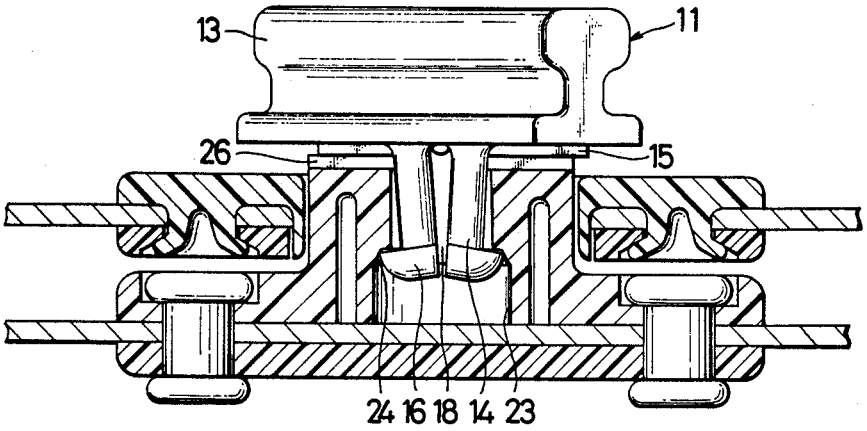

The retainer 12, as shown in FIG. 8, is attached to a fabric C of the briefcase body 2 (FIG. 1) with the fabric C is sandwiched by and between the base 20 and a back plate 30. The back plate 30 and the base 20 are joined together by a pair of rivets 31 extending respectively through a pair of countersunk holes **20*a*, 20*a* in the base 20 and also through a pair of holes (not designated) in the back plate 30**.

The bearing portion 21 of the retainer 12 has a stepped axial through-hole composed of an upper small-diameter portion 22 and a lower large-diameter portion 23 separated by a flat shoulder 25. The large-diameter portion 23 has an upwardly tapering cam surface 24 disposed adjacent to the small-diameter portion 22 and blending into the flat shoulder 25. The cam surface 24 has a height or length substantially equal to or slightly larger than the height of the locking ridges 15. The bearing portion 21 has on its upper end surface **21*a* (FIG. 7) a crisscross guide grooves 26 extending radially outwardly from the stepped hole for receiving the locking ridges 15, respectively, of the latch body 11. The crisscross guide groove 26 has a shape complementary in contour with the shape of the locking ridge 15. The retainer 12 further has an annular groove 27 disposed concentrically outwardly of the stepped through-hole. This groove 27 is provided for purposes of reducing the weight of the retainer 12** and saving the material used.

The latch body 11 and the retainer 12 are assembled together by forcibly inserting the split shank 14 into the stepped through-hole in the bearing portion 21 from the small-diameter portion 22 thereof until the enlarged foot 16 on the shank 14 is snapped with the large-diameter portion 23 of the stepped through-hole, as shown in FIG. 8. In this assembled condition, the upwardly tapering cam surface 24 acts on the upper edge 17 (FIG. 3) of the enlarged foot 16 to urge the shank 14 and hence the latch body 11 downwardly, thereby moving the lower surface **31*a* (FIG. 3) of the grip head 13 toward the upper end surface 21*a* (FIG. 7) of the bearing portion 21. In this instance, if the locking ridges 15 on the grip head 13 are disposed in registry with the guide grooves 26 in the bearing portion 21, the locking ridges 15 will fit into the guide groove 26 by the interaction between the cam surface 25 and the resilient split shank 14, thereby lock the latch body 11 in position against rotation relative to the retainer 12. In this locked position, the lower surface 3*a* of the grip head 13 is held in abutment with the upper end surface 21*a* of the bearing portion 21**.

When the grip head 13 is turned in any direction to move the latch body 11 from the locked position of FIG. 1, the locking ridges 15 on the grip head 13 are released from the corresponding guide grooves 26 and slide onto the upper end surface **21*a* (FIG. 7) of the bearing portion 21, thereby moving the latch body 11 upwardly away from the retainer 12. With this upward movement of the latch body 11, the enlarged foot 16 on the shank 14 is forced to slide upwardly along the upwardly tapering cam surface 24 in the large-diameter portion 23 of the stepped through-hole. During that time, the enlarged foot 16 of the split shank 14 resiliently contracts radially inwardly. The upward movement of the latch body 11 is limited when the upper sharp outer edge 17 (FIG. 1) of the enlarged foot 16 engages the flat shoulder 25 (FIG. 7) of the stepped through-hole in the retainer 12**.

As described above, the latch body 11 of the thumb turn latch 10 has a split shank 14 snap-fitted in a stepped through-hole in the retainer 12, and the retainer 12 has an upwardly tapering cam surface 24 formed on the stepped through-hole adjacent to a flat shoulder 25 thereof. The cam surface 24 acts on an enlarged foot 16 on the split shank 14 when the latch body 11 is moved upwardly away from the retainer 11 as the grip head 13 is turned to move the latch body 11 between a locking position and a releasing position. This combination of the radially contractible shank 14 and the cam surface 24 enables it to use a thick and hence durable bearing portion, such as the bearing portion 21 of the illustrated retainer 12. The thumb turn latch 10 having such durable retainer 12 has a long service life.

Obviously, various modifications and variations of the present invention are possible in the light of the above teaching. It is therefore to be understood that within the scope of the appended claims the invention may be practiced otherwise than as specifically described.

What is claimed is:

1. A thumb turn latch comprising:

(a) a latch body having a grip head and a split shank extending perpendicularly from a lower surface of said grip head and terminating in an enlarged foot, said grip head having on said lower surface at least one locking ridge extending radially relative to a central axis of said split shank; and (b) a retainer movably holding thereon said latch body and including a bearing portion slidably receiving therein said split shank of said shank body, said bearing portion having a stepped hole including a small-diameter portion extending downwardly from an upper surface of said bearing portion and a large-diameter portion contiguous to said small-diameter portion and receiving therein said enlarged foot of said split shank, said large-diameter portion having an upwardly tapering cam surface disposed adjacent to said small-diameter portion and engageable with said enlarged foot to urge said latch body downwardly toward said retainer, said bearing portion further having in said upper surface a crisscross guide groove extending radially outwardly from said stepped hole for receiving therein said locking ridge to lock said latch body in position against rotation relative to said retainer.

2. A thumb turn latch according to claim 1, the number of said locking ridge being four, said four locking ridges being angularly equidistant from one another.

3. A thumb turn latch according to claim 1, said split shank having two longitudinal slots extending perpendicular to one another.

4. A thumb turn latch according to claim 1, said enlarged foot on said split shank having an upper sharp outer edge, said stepped hole including a flat shoulder separating said small-diameter portion and said large-diameter portion and lockingly engageable with said outer edge of said enlarged foot.

5. A thumb turn latch according to claim 1, said cam surface having a height slightly larger than the height of said locking ridge.

6. A thumb turn latch according to claim 1, said locking ridge having a rounded upper edge, said criss-cross guide groove having a shape complementary in contour with the shape of said locking ridge.

7. A thumb turn latch according to claim 1, said latch body and said retainer being molded of synthetic resin.

* * * * *